US007591084B2

(12) United States Patent
Santa Ana

(10) Patent No.: US 7,591,084 B2
(45) Date of Patent: Sep. 22, 2009

(54) INTERCHANGEABLE FOOTWEAR COMPRISING MULTIPLE SHOE INSERTS

(76) Inventor: Roland C. Santa Ana, 224 N. Van Buren St., Rockville, MD (US) 20850

( * ) Notice: Subject to any disclaimer, the term of this patent is extended or adjusted under 35 U.S.C. 154(b) by 797 days.

(21) Appl. No.: 11/057,187

(22) Filed: Feb. 15, 2005

(65) Prior Publication Data

US 2008/0229614 A1 Sep. 25, 2008

Related U.S. Application Data

(63) Continuation of application No. PCT/US02/30045, filed on Sep. 23, 2002.

(51) Int. Cl.
*A43B 3/24* (2006.01)

(52) U.S. Cl. ..... 36/100; 36/15

(58) Field of Classification Search ..... 36/100, 36/101, 15

See application file for complete search history.

(56) References Cited

U.S. PATENT DOCUMENTS 4,246,707 A * 1/1981 Pedersen ..... 36/100
7,010,872 B2 * 3/2006 Pawlus et al. ..... 36/100
7,171,768 B2 * 2/2007 Klein ..... 36/101
7,210,251 B1 * 5/2007 Rolle ..... 36/100
7,284,344 B2 * 10/2007 Pawlus et al. ..... 36/100
2004/0255486 A1 * 12/2004 Pawlus et al. ..... 36/10
2006/0090374 A1 * 5/2006 Hillyer et al. ..... 36/100
2006/0156587 A1 * 7/2006 Pawlus et al. ..... 36/100
2008/0047167 A1 * 2/2008 Pawlus et al. ..... 36/101
2008/0134543 A1 * 6/2008 Klein ..... 36/92

* cited by examiner

*Primary Examiner*—Marie Patterson

(57) ABSTRACT

An article of footwear an outer sole that houses a removable inner sole. The interchangeable nature allows different uses, appearances, and configurations. The outer sole can be used as a shoe itself (e.g. a sandal) or as the sole for other transformations. Various types of footwear elements can be inserted into/over the outer sole, allowing conversion of the footwear into a sports, formal, sandal, water, slipper, dress, ornamented shoe or other footwear.

31 Claims, 11 Drawing Sheets

INTERCHANGEABLE FOOTWEAR COMPRISING MULTIPLE SHOE INSERTS

This application is a continuation application of pending prior international application Number PCT/US2002/030045, filed on 23 Sep. 2002, which designates the United States and which is incorporated herein by reference in its entirety and for which priority is claimed under 35 U.S.C. §120.

TECHNICAL FIELD

This invention relates in general to footwear and, more particularly to a shoe of a selectively versatile character, which is uniquely constructed for interchangeability of use.

BACKGROUND ART

Heretofore, numerous efforts have been undertaken to develop shoes for men and women that in appearance through facile alteration by the wearer. Prior art is extensive with footwear having changeable components to achieve a variety of purposes.

Most of such earlier attempts have been directed to what might be considered ornamental effects to increase the style of the shoe, such as shown in Smith's U.S. Pat. No. 4,267,649. Other efforts have been directed toward alternation in components for style, purposes of color and design; see e.g. Bailey's U.S. Pat. No. 4,887,369; Smith's U.S. Pat. No. 4,267,649; Halford's U.S. Pat. No. 5,083,385; Blakely's U.S. Pat. Pub. No. 2001/0052195 A1; Dupree et al. U.S. Pat. No. 5,848,484; and Dupree's U.S. Pat. No. 4,958,447.

Additionally, various efforts have been made to create a versatile shoe for athletic purposes. Most of such attempts have been for one specific athletic purpose or another (e.g. roller skating or bowling), such as Clementi's U.S. Pat. No. 4,706,392. Other interchangeable shoes focused on creating a sole suitable for the insertion of tools to practice various sports as shown by Schaefer's U.S. Pat. No. 4,114,295 and Aveni's U.S. Pat. No. 5,459,948.

There has been some focus in creating a versatile water shoe, although not interchangeable, serving many purposes as shown by U.S. Pat. Nos. 5,802,740; 5,960,565; 5,732,480; 5,771,610; and 5,737,853.

Yet other inventions have focused on making a comfortable, affordable, easy to use versatile shoe. For example, Throneburg's U.S. Pat. No. 5,724,753 discloses a footwear system that includes a sock specifically made for the shoe. Others patents simply disclose slippers and sandals that are lightweight and affordable for beach use, e.g. Huard et al. U.S. Des. Pat. No. D450,179 S.

SUMMARY OF THE INVENTION

The present invention embodies an interchangeable article of footwear. The footwear includes an outer sole of unitary construction and an inner sole adapted to be housed by the outer sole. The outer sole of unitary construction includes a united toe, central and heel portion. The top sole sits upon the toe, central and heel portion of the shoe making it a single unit. This outer sole unit can be used as a shoe itself, as a sandal, or as the sole for other transformations of footwear.

The central portion of this outer sole unites toes and heel portion be an arch supporter which made be covered with materials such as Kevlar or composite materials. As a fastener for the outer sole, two bands of materials, such as hook-and-loop fasteners, can attach by a variety of means around the toe and ankle portion of the shoe. The ankle portion is also attached to a heel supporter that curves around the upper back heel of the shoe. The ankle portion is also attached to a heel supporter that curves around the upper back heel of the shoe. The abovementioned increased arch support permits sliding of wearer's arch. It also permits ready flexing and bending of the shoe within a zone intermediate to the heel and sole to provide increased walking comfort and natural flexing.

The outer sole may include a mechanism to adjust the height of the same or the softness/firmness level of the shoe. The preferred mechanism includes a dial, a switch mechanism; and may include a magnetic fluid (or MR fluid) that may serve as a shock absorber and to adjust the softness/firmness of the footwear. The mechanism may be placed at different location of the outer sole.

The sandal is the bottom sole of the interchangeable article of footwear invention, wherein diverse interchangeable inner shoes (also referred to as inner soles) may be inserted at user's preference. Wearer according to his or her specific needs or intended use can combine this inner shoe style and outer shoe type. Therefore, this outer sole may include variations of this invention by inserting one of the components or inner shoes/soles mentioned herein under, but it may also be worn as a sandal on its own.

The inner footwear (inner shoe or inner sole) is an interchangeable component that is housed by the outer sole without being permanently attached to the outer sole or sandal. Moreover, this component may be inserted into the outer sole or sandal and used as a sneaker, amongst other uses. The sports shoe or sneaker can be removed and the sandal worn on its own.

Other preferred versions of the present invention include an inner sole adapted to replicate to configuration, comfort, and uses of a water shoe, slipper, or sock insole. A preferred sock insole includes a two unit padding, one unit to be attached to the upper portion of the sock's heel and the other for the lower portion of the sock's heel. Padding in two units enables the sole to be attachable to socks of different sizes. In addition, the sock may include an elastic strap at the middle of the sock, providing wearer with massages. This elastic strap assists the wearer relieve pain and serve as an extra foot support.

OBJECTS AND ADVANTAGES OF THE INVENTION

The present invention constitutes a significant improvement in several aspects over such previously identified efforts of the cited references and the prior art. Although the abovementioned patent examples may be suitable for the particular purposes that they address, they are not suitable for the purposes of the present invention heretofore described.

Accordingly, an object of the invention is to provide a shoe designed for men, women, and children and having components of an interchangeable nature which are uniquely independent to provide greatly improved quick and simple alteration of the shoe to effect numerous uses permitted by said components.

Another object of the invention is to provide a shoe of the character stated which will accommodate various foot sizes and yet, for all such sizes is not only comfortable to the wearer, but also retains "imperative usefulness."

A further object of the invention is the provision of a shoe that permits ready flexing and bending of the shoe within a zone intermediate the heel and sole to provide increased walking comfort and natural flexing.

A still further object of the present invention is to provide a shoe with increased arch support for the wearer to enhance walking comfort. In the junior version (for children or teenagers) the increased arch support is particularly important given low friction materials used for the arch support, such as Kevlar, carbon fiber, Teflon, or any man made plastic. This band surface would permit sliding of wearer's arch.

Another object of the invention is to provide a shoe that provides a stable and mechanically secure structural nature with the independent component of the sandal footwear and which should become even more stable and mechanically secure when the components of the shoe are in their various states of assembly.

Yet another object of the invention is to provide a shoe that embodies cooperative elements that are selectively configured by easy manipulation to provide quick and easy alteration of the utility and the appearance of the shoe.

It is a further object of the present invention to provide a shoe with multiple interchangeable constituents which may be easily disposed into chosen activity without resort to extrinsic tools and without requiring advance skill on the part of the wearer so that the average individual can quite simply and rapidly bring about the desired use within the range provided.

It is a still further object of the present invention to provide a shoe adapted for supporting various uses corresponding to particular activities through the attachment or detachment of a particular shoe to the outer sole.

An additional object of this invention is to provide an article of footwear that may be accommodated as a sock insole or sock slipper including elastic that provides increased firmness of the sock and massages wearer's foot. This sock insole or sock slipper can also assist the wearer relieve pain and serve as an extra foot support.

It is yet another object of the present invention to provide a shoe of the character stated which may be most economically manufactured; which is extremely durable in usage; and which in and of itself serves the purpose of several pairs of shoes so as to bring about a substantial savings to the user.

These objects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DESCRIPTION OF PREFERRED EMBODIMENTS

Figure 2:
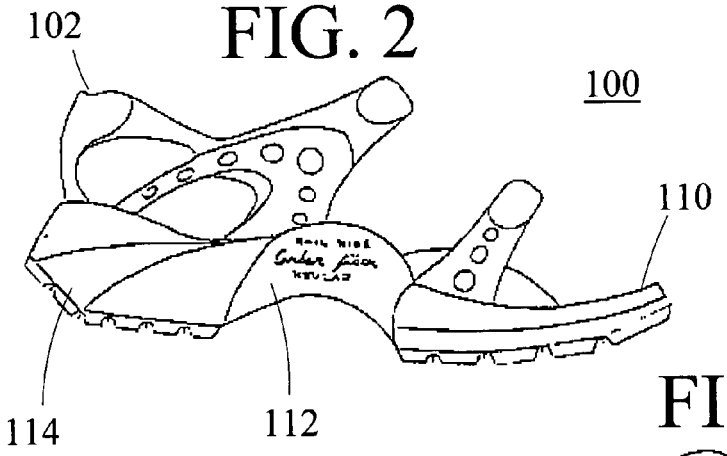
FIG. 2 is a side view of the footwear as an outer sole or sandal.
Figure 3:
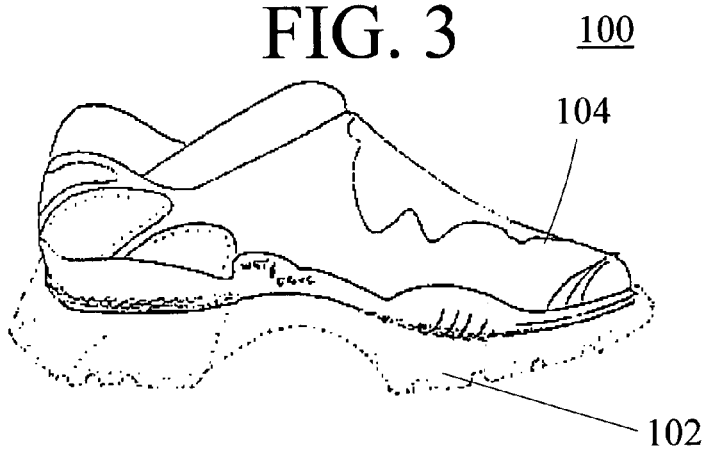
FIG. 3 is a side view of the footwear as a water shoe without the outer sole or sandal attached.

Turning first to FIG. 1A-D, the present invention embodies an interchangeable article of footwear 100. As FIGS. 2 and 3 show, the footwear 100 includes an outer sole 102 of unitary construction and an inner sole 104 adapted to be housed by the outer sole 102. The outer sole 102 of unitary construction includes a united toe portion 110, central portion 112, and heel portion 114. The top sole includes the toe, central, and heel portion of the shoe making it a single unit. This outer sole unit can be used as a shoe itself, as a sandal, or as the sole for other transformations of footwear. The outer sole may be made of various materials such as inflexible materials including wood, metal, and the like or flexible materials including rubber, plastic, leather, fabric or man-made materials.

The central portion 112 of this outer sole unites toe portion 110 and heel portion 114 by an arch supporter. In the preferred embodiment of the invention, this arch supporter may be covered with materials such as but not limited to Kevlar or composite materials. Other embodiments of the present invention may include a curved toe portion for increased firmness of the wearer's foot inside the outer sole.

Figure 4:
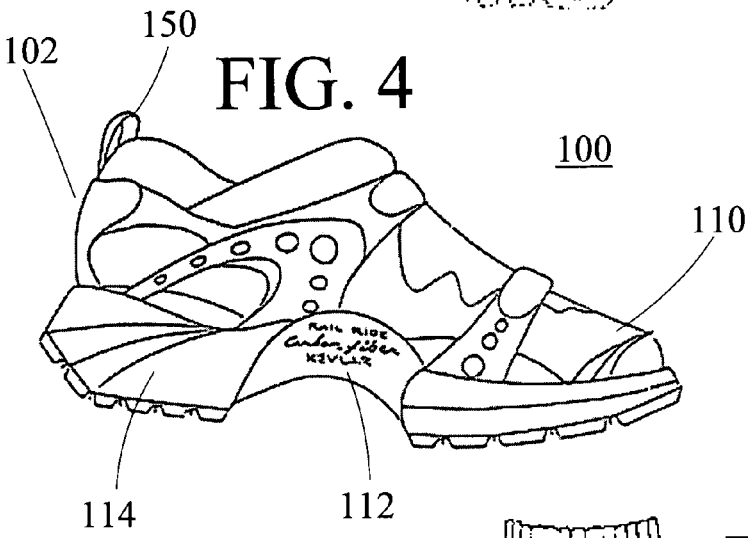
FIG. 4 is a side view of the invention comprising the sandal or outer sole with a sports shoe as the inner sole/shoe inserted into the outer sole.
Figure 5:
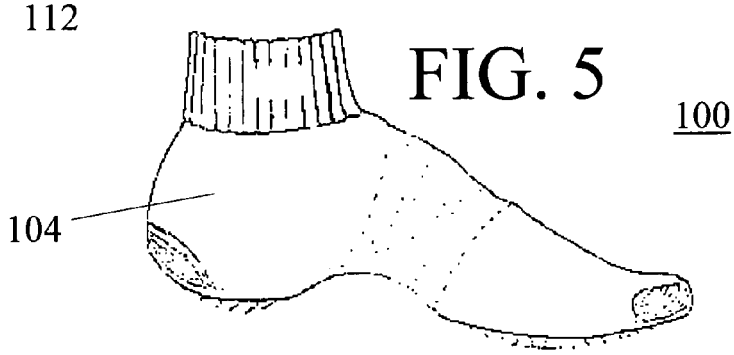
FIG. 5 is a side view of another embodiment of the footwear without the outer sole or sandal attached.
Figure 10:
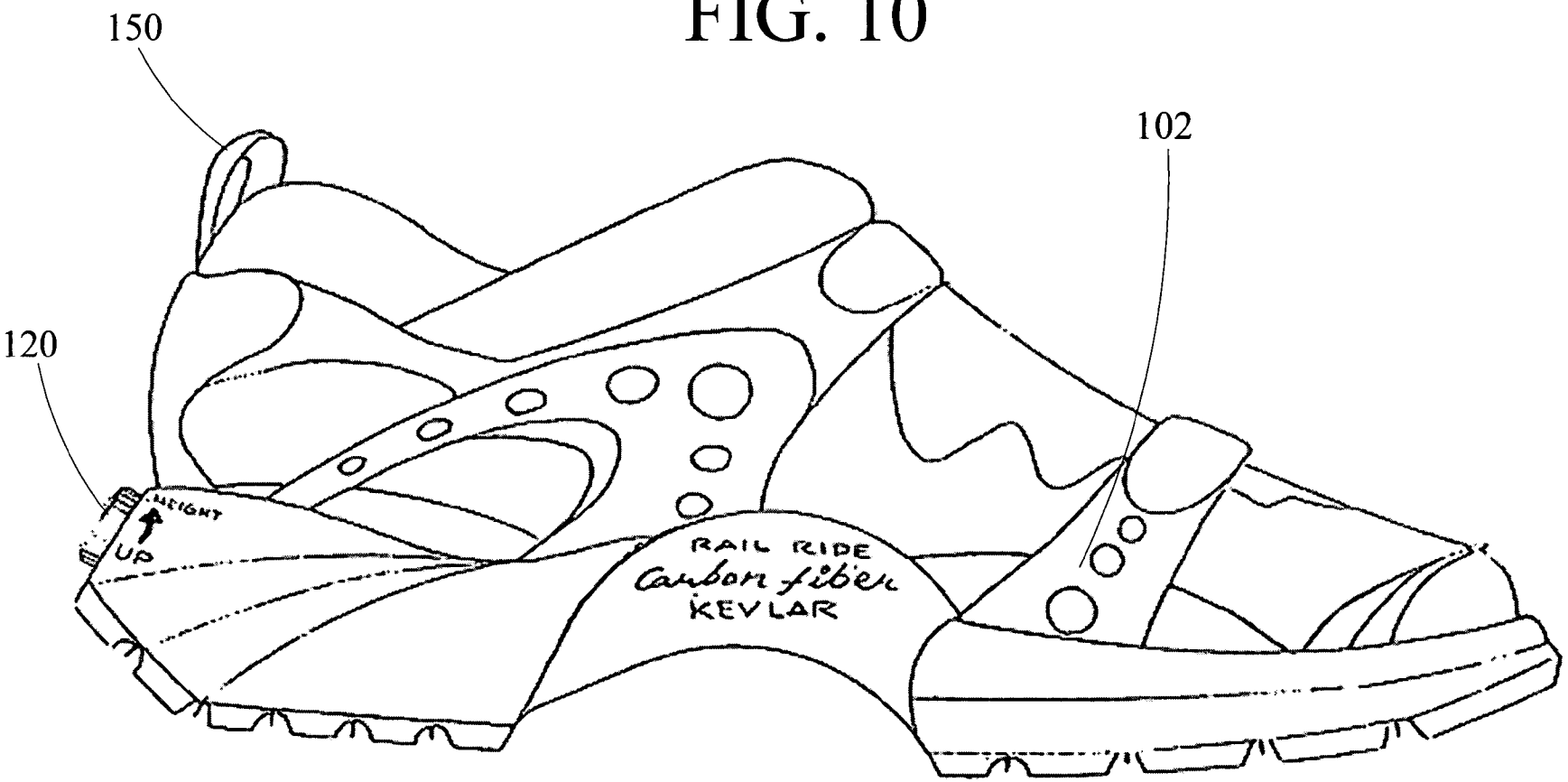
FIG. 10 is a side elevation view of the one embodiment of the outer sole or sandal of the invention featuring the dial control.
Figure 11:
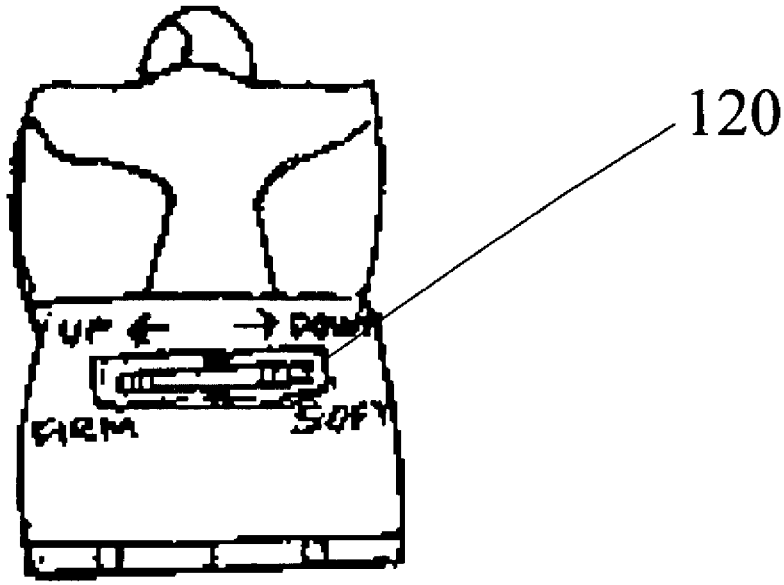
FIG. 11 is a front view of one embodiment of the outer sole or sandal of the invention, featuring the dial control mechanism.

Turning now to FIGS. 4 and 5, two bands of materials, e.g. VELCRO, attach by a variety of means around the toe and ankle portion of the outer sole 102 of the shoe 100. The ankle portion 114 is also attached to a heel supporter that curves around the upper back heel of the outer sole 102 of the shoe 100. The abovementioned increased arch support permits sliding of wearer's arch. It also permits ready flexing and bending of the shoe within a zone intermediate to the heel and sole to provide increased walking comfort and natural flexing. FIG. 4 and FIG. 10 further depict an outer sole handle 150. The handle 150 is an outcropping of the outer sole 102 that allows a wearer to grasp the outer sole 102 while removing his foot from the interior of the outer sole 102.

As FIGS. 9-12 illustrate, the outer sole may include an adjustment mechanism 120 to adjust the height of the same or the softness/firmness level of the shoe. This adjustment mechanism 120 includes a dial and to a switch mechanism; wherein rotation of the dial would actuate a threaded lift screw, and displacement of the switch would actuate a lever lift platform. Preferred materials for the composition of the adjustment mechanism include metals and plastics. The mechanism may also include a magnetic fluid (or MR fluid) that may serve as a shock absorber and to adjust the softness/firmness of the footwear. This mechanism may be placed at different locations of the outer sole, such as the rear end section of the sole or on a lower end section of the sole. The preferred embodiment of the invention includes a dial mechanism working in mechanical conjunction with the magnetic fluid to adjust these characteristics at user's preference. In the preferred embodiment, this dial mechanism is placed on the rear end section of the sole, as per FIGS. 10 and 11. In addition, this mechanism 120 may be adjusted manually, mechanically, or electronically. In the preferred embodiment, this mechanism shall be adjusted manually. In the preferred embodiment, this mechanism shall be adjusted manually.

Figure 9:
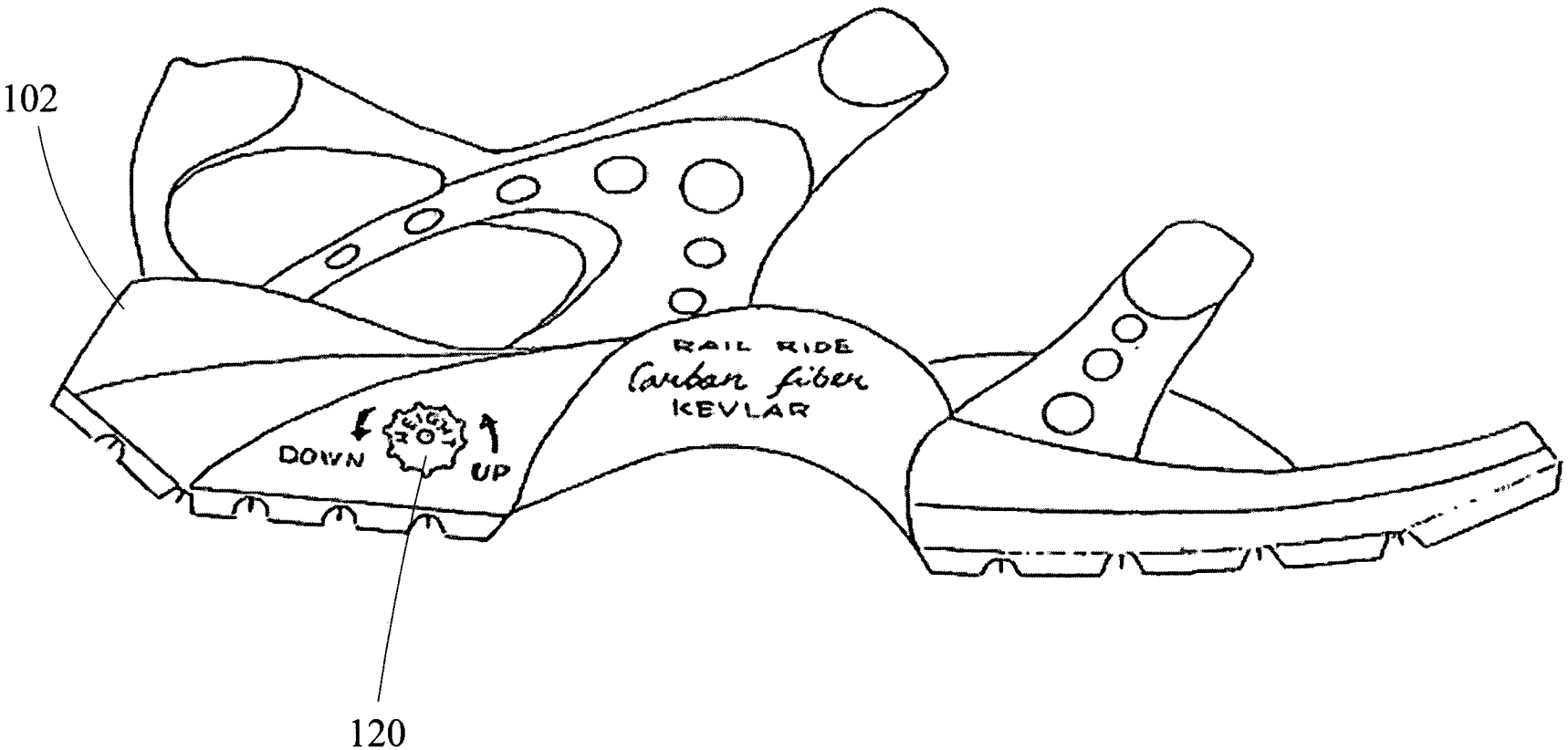
FIG. 9 is a side view of one embodiment of the outer sole or sandal of the invention featuring the dial control mechanism.

Generally designated in FIGS. 2 and 9 is a sandal 100 embodiment of the present invention. The outer sole 102 accepts diverse interchangeable inner shoes (not shown), which may be inserted at user's preference. Wearer according to his or her specific needs or intended use can combine multiple inner sole styles with the outer sole 102. Therefore, this outer sole 102 may include variations of this invention by inserting one of the components or inner shoes/soles, but it may also be worn as a sandal on its own.

The preferred embodiment of this element of the invention is constructed of leather or any man made materials. The material from which the present invention is constructed should ensure that the configuration of the outer sole remains unaltered structurally upon the inclusion and removal of the inner sole.

Figure 6A:
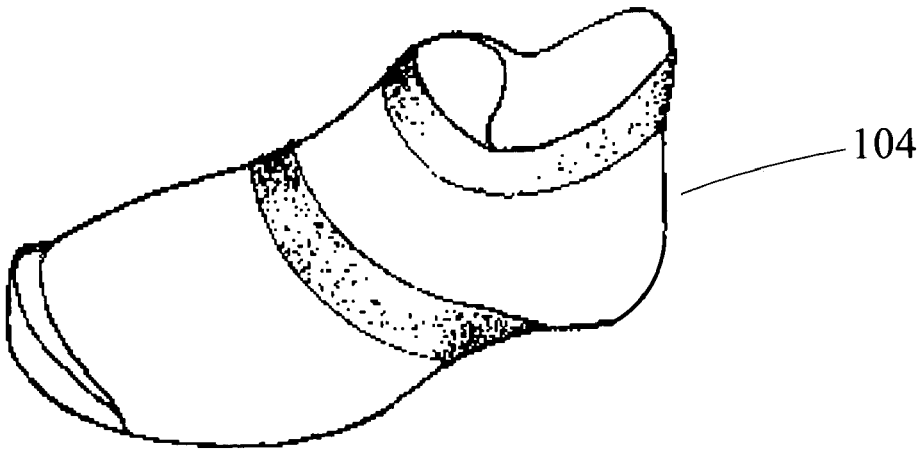
FIG. 6A and FIG. 6B are side elevation views of, from left to right, the sports shoe without the outer sole attached (FIG. 6A) and of the outer sole/sandal (FIG. 6B).
Figure 6B:
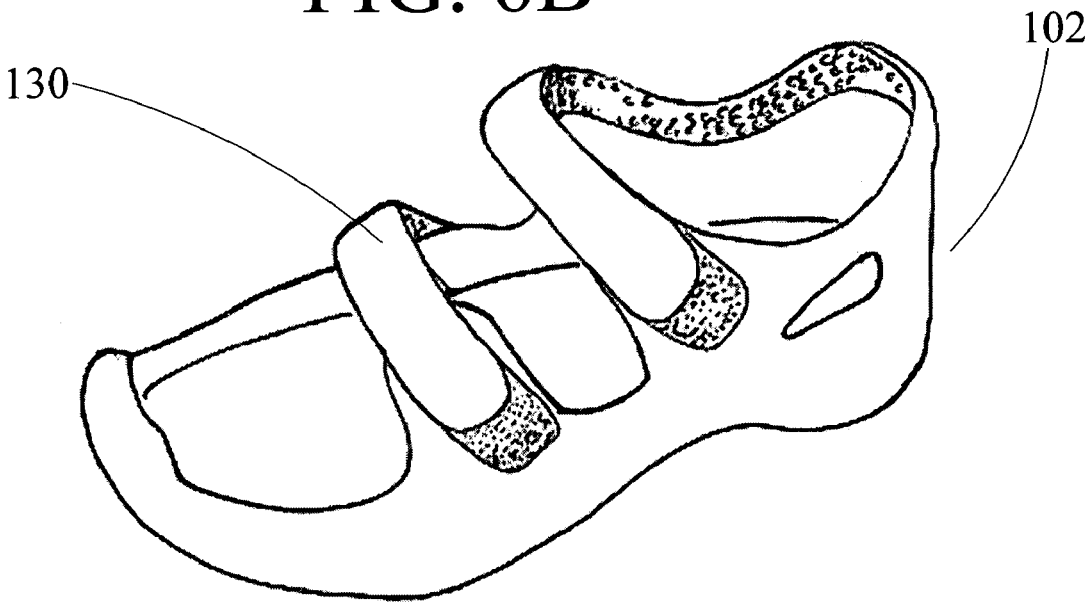
Figure 7:
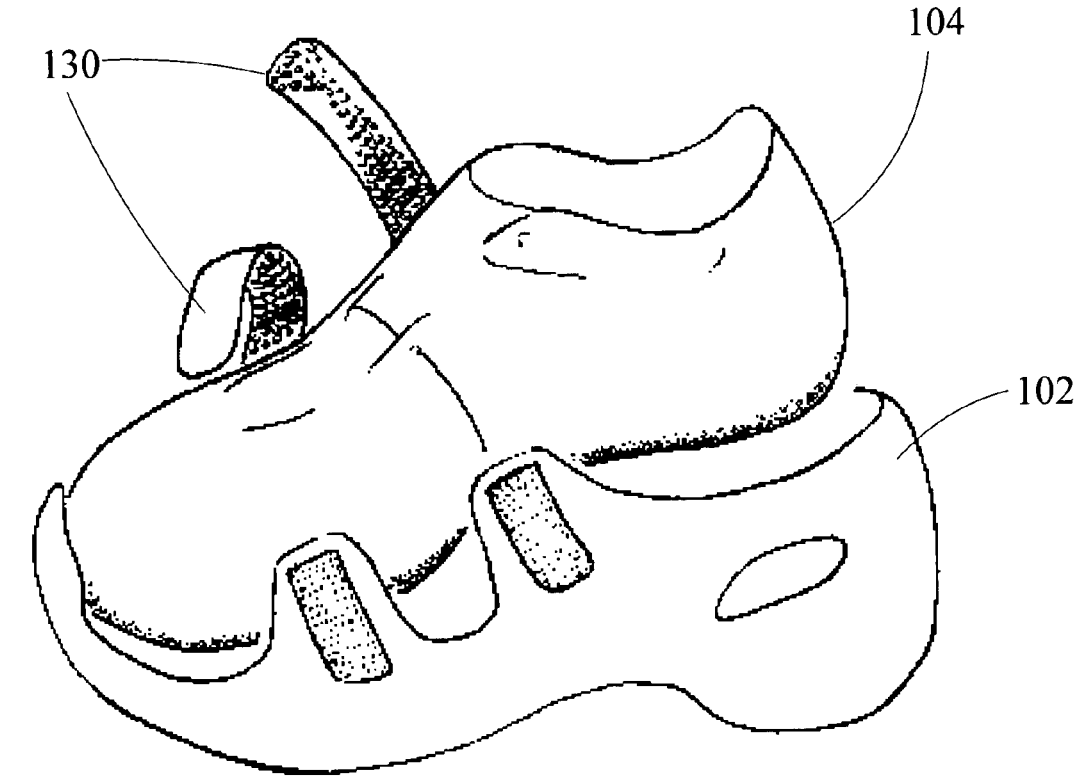
FIG. 7 is a side elevation view of the sports shoe and the outer sole or sandal.
Figure 8:
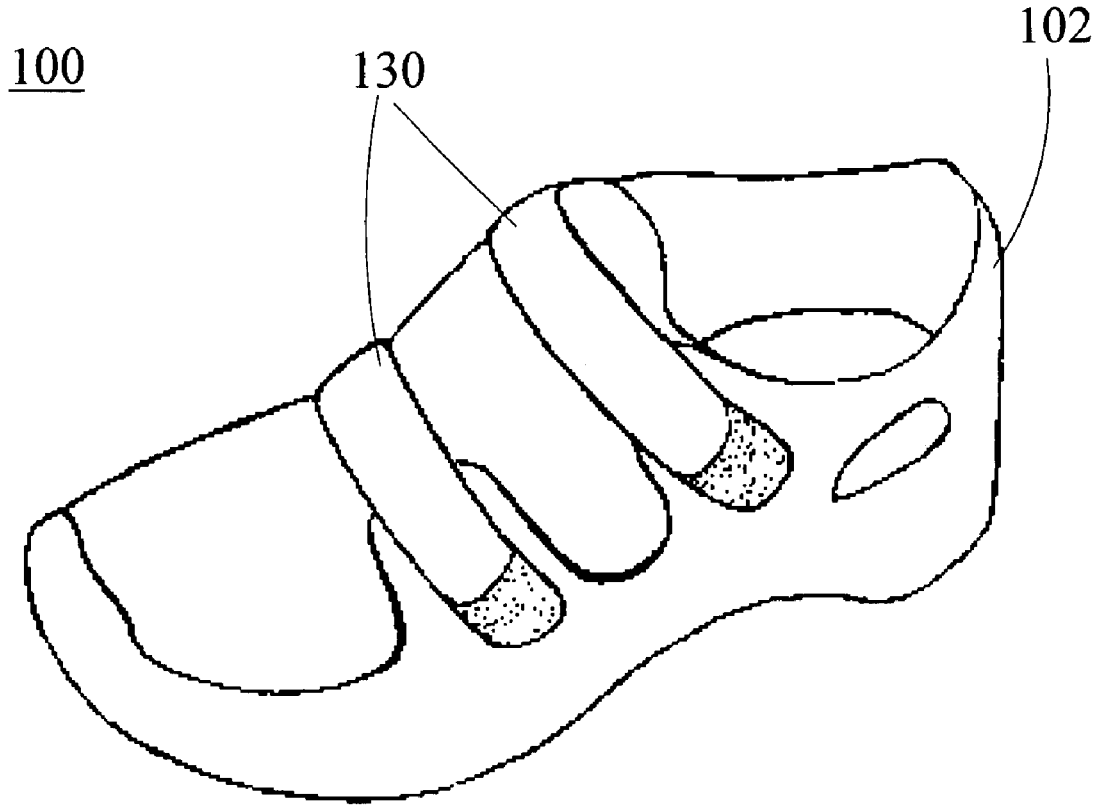
FIG. 8 is a side view of the interchangeable shoe.

FIGS. 6-8 illustrate the physical interrelationship between the outer sole 102 and inner sole 104 of the present invention. The inner sole 104 may be used without being attached to the outer sole or sandal. Moreover, this component may be inserted into the interior of the outer sole 102 or sandal and used as a sneaker, amongst other uses. As shown by FIG. 6B, the outer sole 102 need not necessarily include physical attachment means located on the inner sole (not shown); rather, in most instances it will be sufficient that the fastener 130 of the shoes obstruct the release of the inner sole 104—as opposed to physical anchoring means (e.g. VELCRO) located on both the interior of the outer sole and the interior of the inner sole. As shown by FIG. 6B and FIG. 1B, the preferred fasteners 130 of the present invention include VELCRO straps and shoelaces; however, other forms of fasteners known in the shoe arts will similarly be amenable to the present invention. As detailed by FIG. 7, the inner sole 104 enters the interior of the outer sole 102 by the same route that the human foot would take; which in the case of VELCRO fasteners may be through the fasteners, or in the case of shoelaces, may be only through the foot entrance and not through the released fasteners. The sports shoe or sneaker can be removed and the sandal worn on its own.

FIGS. 4 and 8 illustrate the preferred embodiment of the footwear as a sports shoe or sneaker. Here, the inner sole has been strapped and secured to the outer sole and are both worn in conjunction.

Figure 1D:
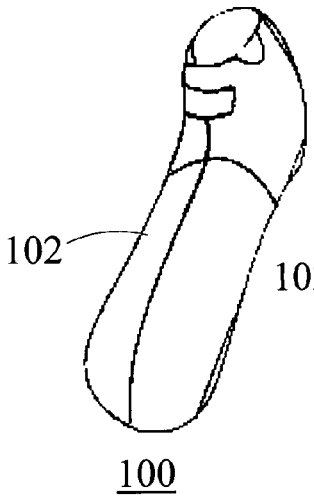
FIG. 1A to 1D are side elevation views of the embodiments of the footwear, from right to left, as an outer sole or sandal (FIG. 1A), sports' shoe (FIG. 1B), water shoe (FIG. 1C), and sock insole/slipper shoe (FIG. 1D).
Figure 1C:
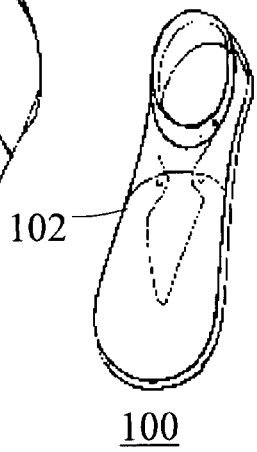
Figure 1B:
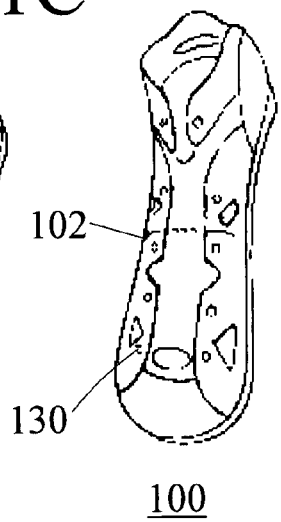
Figure 1A:
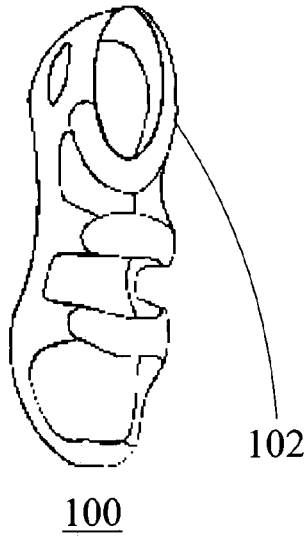

FIGS. 1C and 3 illustrate the water shoe 100, which is preferably made of rubber or any other made material resistant to water. This is a water impermeable shoe and may have alternative uses to that of an article of footwear to be used in or with water. This element of the invention may be used as an entity to which the outer sole 102 can be attached and the footwear 100 worn as a beach sandal.

Figure 13:
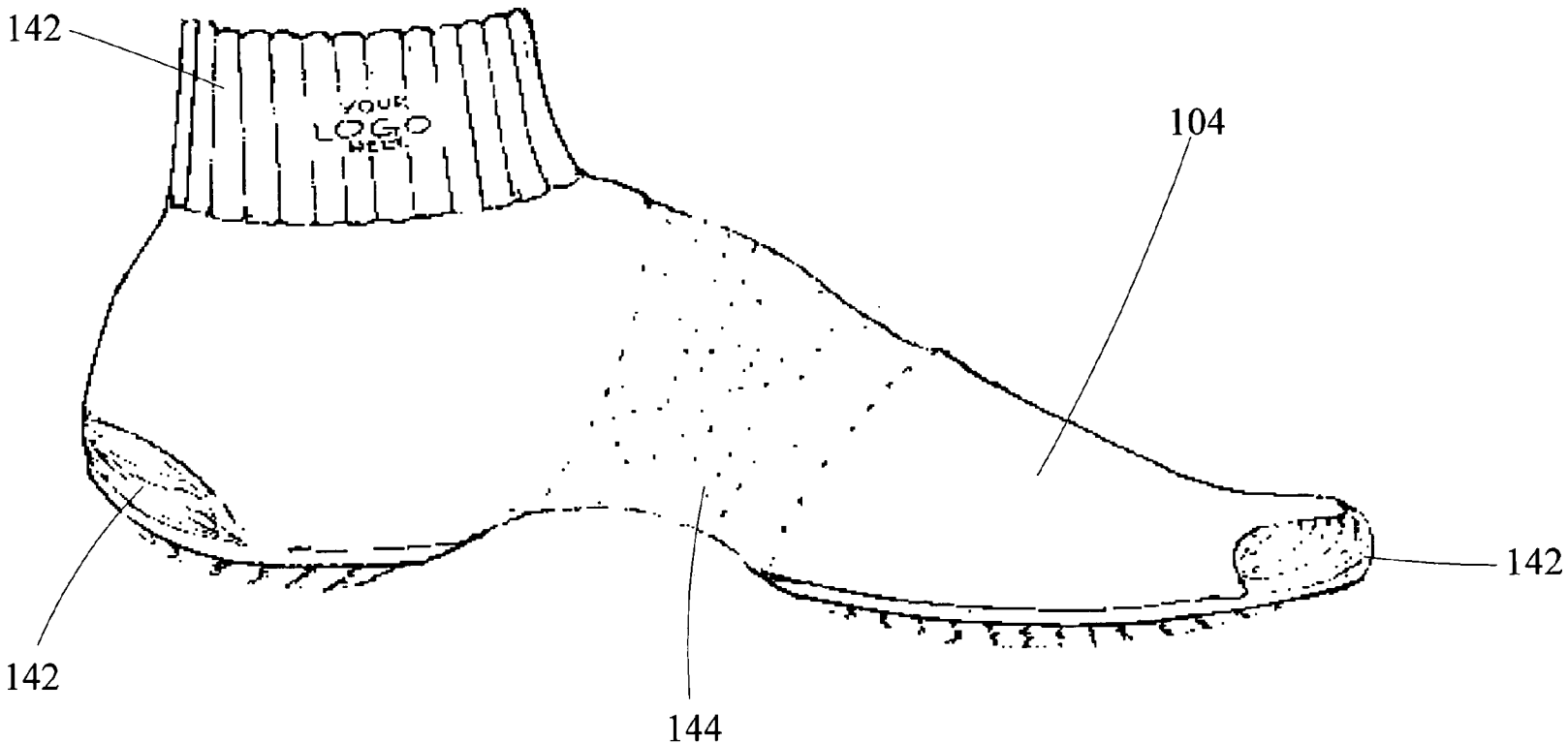
FIG. 13 is a side view of one of the independent inner soles of the invention, the sock insole.

As shown by FIG. 13, A preferred sock insole 104 acts to mimic a slipper and includes a two unit padding, one padding unit 142 to be attached to the upper portion of the sock's heel and the other padding unit 142 for the lower portion of the sock's heel. Padding in two units enables the sole to be attachable to socks of different sizes. In addition, the sock may include an elastic strap 144 at the middle of the sock, providing wearer with massages. This elastic strap 144 assists the wearer relieve pain and serve as an extra foot support.

In instances where in the insole is a sock, the sock may be made of materials such as but not limited to cotton, nylon, etc.; the outer sole may be made of materials such as but not limited to plastic, gel, rubber, or leather.

Figure 12:
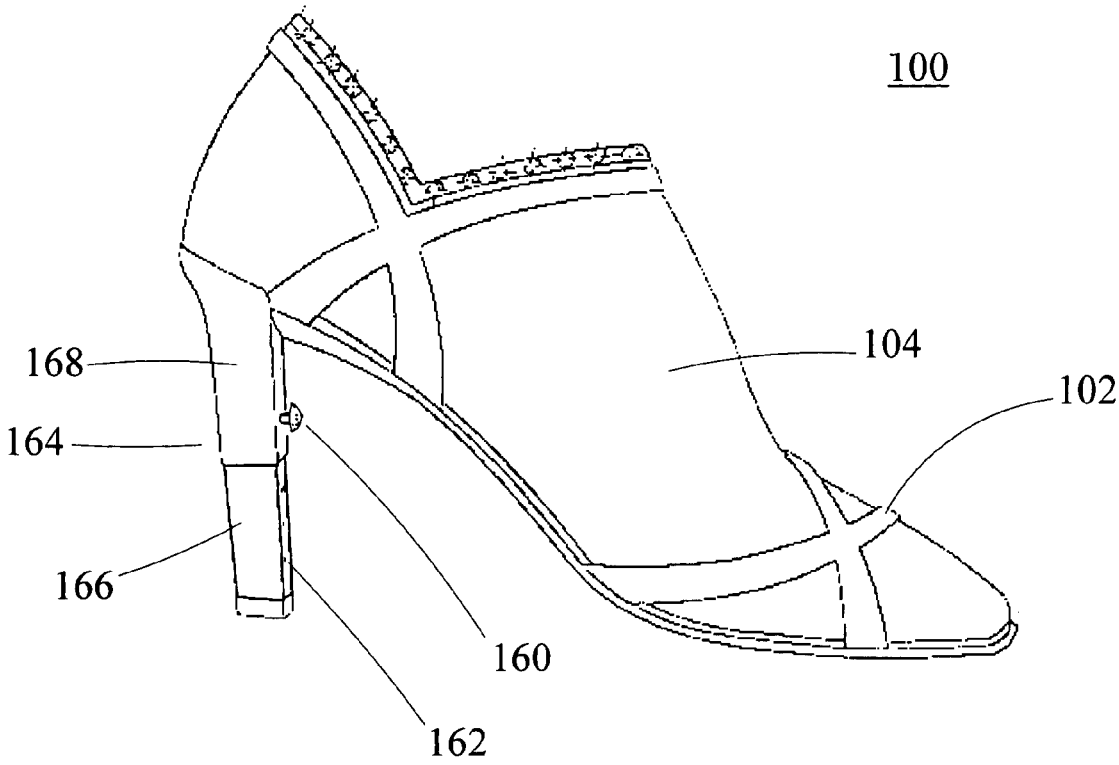
FIG. 12 is a side view of the one embodiment of the invention
Figure 14:
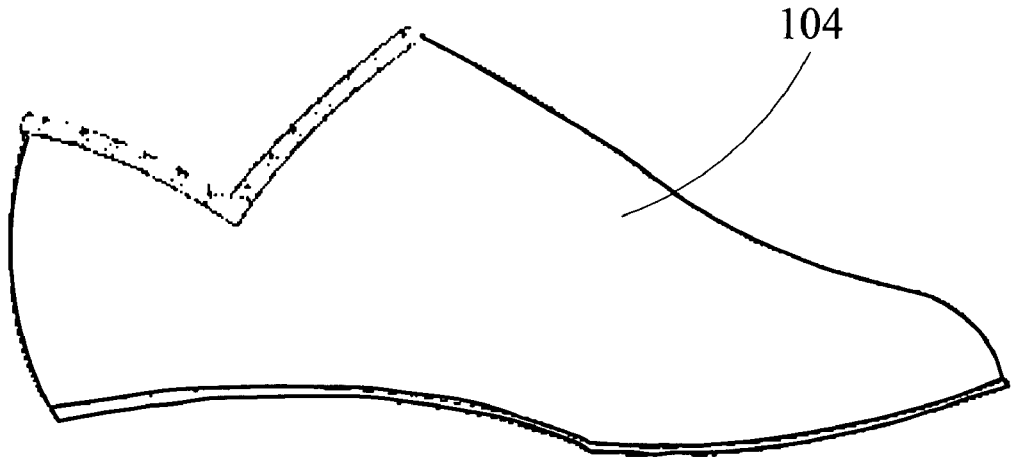
FIG. 14 is a side view of an inner sole or inner shoe.

FIGS. 12 and 14 show an evening shoe 100 of the present invention with an alternate version of the adjustment mechanism. The adjustment mechanism includes a pin 160 adapted to fit into multiple grooves 162. The heel 164 includes a perforated lower heel portion 166 slidably inserted into an upper heel portion 168. The upper heel portion 168 includes at least one groove 162 to mate with one or more grooves on the lower heel portion 166. To adjust the height of the evening shoe 100, the user would simply remove or release the pin 160, slide the lower heel 166 to the proper adjustment setting such that a groove of the upper heel is flush with a groove of the lower heel, and insert the pin. The inner sole 104 is removable from the outer sole 102.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

Having described my invention, what I claim is:

1. An interchangeable article of footwear selectively reconfigurable as a sandal, shoe or sports shoe, water shoe, sock insole or slipper character, said article of footwear comprising:

a) An outer sole of unitary construction having a toe portion, a central portion and a heel portion; such article also having an attaching stay or strap extending upwardly from the arch portion of said outer sole further accompanied by an attaching strap extending upwardly from the toe portion of said outer sole; both said straps as means for detachably securing said outer sole to the foot in a comfortable position;

b) An inner sole or independent article of footwear which may be inserted into and secured to the said outer sole or used independent of the same; said inner sole being another shoe or a sports shoe, selected from the group consisting of a slipper, flat, formal, driving, indoor, walking or comfort/therapy shoe;

c) An inner sole or independent article of footwear which may be inserted into and secured to the said outer sole or used independent of the same; said inner sole being a water permeable shoe and referred to as a "water shoe";

d) An inner sole or independent article of footwear which may be inserted into and secured to the said outer sole or used independent of the same; said inner sole being a sock with an attached sole, and referred to as a "sock insole" or slipper.

2. An article of footwear as defined in claim 1, said outer sole being of substantially constant thickness whose outer sole functions include rigidity required for sports or hiking shoe and the comfort of a sandal; and said outer sole comprising a curved toe portion for increased firmness and increased sole contact with the ground during foot acceleration.

3. An article of footwear as defined in claim 1, various inner soles being provided with a plurality, and variability each such inner soles thus effectively fitting securely into the outer sole sandal.

4. An article of footwear such as defined in claim 1, the inner soles being liftably detachable from said sandal or outer sole by movement upward relative to said outer sole about a first hinge-defining means.

5. An article of footwear such as defined in claim 1, wherein the inner sole is a sports' or hiking shoe with an ankle and arch support and a highly pliable sole, the inner sole adapted to be inserted and secured to the outer sole.

6. An article of footwear such as defined in claim 1, being the water shoe comprised of a slipper made of water impermeable material which can be worn without the outer sole to protect the wearer when feet are in the water, or on a sandy or soft surface, wherein such slipper can enter into the outer sole to be worn as a beach sandal.

7. An article of footwear as defined in claim 4, and further comprising a front upper, means for providing detachable inter-engagement of said front upper with the toe portion of said inner sole, said inner sole and upper providing selective removal and replacement as a single unit upon said outer sole, said front upper comprising at least one securing strap oriented fore extending transversely of said article of footwear interposed between the toe portion of said outer sole and the toe portion of said inner sole, said unit being capable of extrinsic separation of said inner sole and front upper, whereby replacement of reconfiguring of said front upper is made convenient and easy for the user.

8. An article of footwear as defined in claim 5, said outer sole being defined by at least two straps of material adapted to extend across the forepart of the foot of the user for use as sandal footwear or to secure interchangeable shoes; said outer sole may also be fastened by means selected from a group consisting of a buckle, snap-on, lace, hook and loop fastening means or any other method involving fabric with a zipper.

9. An article of footwear as defined in claim 1, the outer sole being constituted by material adapted to extend across the forepart of the foot of the user, said material having marginal portions passing under a selected one of the inner soles at the sides thereof.

10. An article of footwear as defined in claim 1, the rear surface of said heel being provided with a vertically extending recess for securing interchangeable shoe or providing stability for said sandal.

11. An article of footwear as defined in claim 1, a selected one of the inner soles having a rearward edge with an aperture, said adjusting strap passing through said aperture, said means detachably securing said strap to the outer sole.

12. An article of footwear as defined in claim 1, said outer sole defining means comprising a rear quarter, said rear quarter having strap portions extending downwardly there from and thence under the heel portion of said outer sole, and means for detachably securing said strap portions.

13. An article of footwear as defined in claim 1, wherein an arch of one of the soles is lined or made with a material selected from the class of materials including Kevlar™ and carbon composite materials so as to provide a smooth surface for low friction sliding on a curved surface or a pole.

14. An article of footwear as defined in claim 1, wherein said outer sole includes a mechanism for manually, mechanically or electrically adjusting the height of such outer sole or heel of said outer sole; such mechanism being located under the heel and arch or extending to the toe as a whole.

15. An article of footwear as defined in claim 14, wherein said mechanism is selected from the group of mechanisms including dial, switch, magnetic fluid, hydraulic, air pressure, gas pressure, and spring elements to partially adjust the height of the sole bed or entirely adjust the height of the footwear and for the purpose of changing the performance of the footwear.

16. An article of footwear as described in claim 1 wherein the outer sole includes a mechanism for manually, mechanically or electrically adjusting the firmness or softness of such article of footwear; such mechanism being located at the toe and heel area, or extended from the heel to the toe as a whole for the purpose of comfort and performance of the footwear.

17. An article of footwear as described in claim 16 wherein such mechanism is selected from the group of mechanisms including dial, switch, magnetic fluid, hydraulic, air pressure, gas pressure, or spring elements to partially adjust the height of the sole bed or entirely adjust the height of the footwear.

18. An article of footwear such as defined in claim 1 wherein one of the inner soles is inserted into and secured to the outer sole, and said outer sole includes a heel with adjustable height; such article of footwear includes a scissor jack of foldable shoring/support method.

19. An article of footwear such as defined in claim 18 wherein said adjustable heel is comprised of a first and a second unit, the first unit having a hollow chamber which is attached to the outer sole and the second unit having perforations being securely sliding in and out of the first unit which is fastened by means selected from the group including screws and pins.

20. An article of footwear such as defined in claim 19 wherein the adjustable heel section is of shapes selected from the group of shapes including rods, screws, rectangles, rectangles with a flat bottom, mill turnings, molded decorations, telescoping designs, tubes with a round bottom, machine turnings and points, that slide in and out of the hollow chamber which is secured to the footwear.

21. An article of footwear such as defined in claim 18 wherein the heel is comprised of a hollow chamber made of metal, containing inside the chamber an element of adjustable height selected from the group of adjustable height elements including hydraulic, spring, air and gas pressure, and screw jacks, said element covered by the chamber material.

22. An article of footwear such as defined in claim 1, wherein the sock insole element comprises a sock made of materials selected from the group consisting of cotton or man made fabrics with a built-in insole or an outer sole; said sock comprising an elastic material around the arch of the foot to fit and for grip of the sock to wearer's foot, and said built-in insole or outer sole made of materials selected from the group consisting of gel, rubber, leather, plastic or man made materials.

23. An article of footwear such as defined in claim 22 wherein said sock insole includes a one unit insole or sole for partially or totally covering wearer's foot.

24. An article of footwear such as defined in claim 22 wherein said sock insole has a two unit or more sole with a two unit padding made of materials selected from the group consisting of rubber, leather, plastic or man made materials.

25. An article of footwear such as defined in claim 22 wherein said sock insole is comprised of divisional patterns of an insole in order to stretch the fabric to fit wearer's foot.

26. An article of footwear such as defined in claim 22 wherein said sock insole includes an insole which is applied, coated, printed on, sprayed on, stuck on, dipped on or padded on to the sock.

27. An article of footwear such as defined in claim 22 wherein said sock has a built-in insole to protect the foot of the wearer from shock, impact, slip and change in temperatures specially when worn by itself.

28. An article of footwear such as defined in claim 22 wherein said sock has a built-in insole for therapy when used in conjunction with an ill-fitted or improper shoe; being the effect of this insole therapy to give extra-soothing cushioning from pain obtained from inferior fitted footwear.

29. An article of footwear such as defined in claim 1 including an interlocking design sole for interchangeable footwear wherein the inner sole edges interlock with the outer sole inside its own sole or undercut; such design consists of a v-shape, u-shape, or square shape interlocking inside and outside soles together.

30. An article of footwear as defined in claim 1, wherein an arch of one of the soles is lined or made with materials selected from the group of materials including Kevlar™ and plastic, metal and carbon composite so as to provide a smooth surface for low friction sliding on a curved surface, providing a benefit to cyclists without the shoe cleat to comfortably step on the pedals of a bicycle or similar pedal device.

31. An article of footwear as defined in claim 22 wherein said elastic material is built in around the arch portion of the sock, providing an extra foot support to the ligaments and tendons of wearer's foot; therefore having therapeutic value.

* * * * *